US010563149B2

(12) United States Patent
Terauchi et al.

(10) Patent No.: US 10,563,149 B2
(45) Date of Patent: Feb. 18, 2020

(54) CONDUCTIVE LUBRICATING OIL COMPOSITION AND SPINDLE MOTOR

(71) Applicants: Cosmo Oil Lubricants Co., Ltd., Tokyo (JP); Nidec Corporation, Kyoto (JP)

(72) Inventors: Ryuji Terauchi, Saitama (JP); Yuji Hagiwara, Kyoto (JP)

(73) Assignees: Cosmo Oil Lubricants Co., Ltd., Tokyo (JP); Nidec Corporation, Kyoto (JP)

( * ) Notice: Subject to any disclaimer, the term of this patent is extended or adjusted under 35 U.S.C. 154(b) by 0 days.

(21) Appl. No.: 16/161,471

(22) Filed: Oct. 16, 2018

(65) Prior Publication Data

US 2019/0119598 A1 Apr. 25, 2019

(30) Foreign Application Priority Data

Oct. 19, 2017 (JP) ..... 2017-202533

(51) Int. Cl.
*C10M 169/04* (2006.01)
*C10M 105/34* (2006.01)
(Continued)

(52) U.S. Cl.
CPC ..... *C10M 169/04* (2013.01); *C10M 105/34* (2013.01); *C10M 129/10* (2013.01);
(Continued)

(58) Field of Classification Search
CPC ..... C10M 169/04; C10M 105/34; C10M 133/12; C10M 135/10; C10M 2219/044;
(Continued)

(56) References Cited

U.S. PATENT DOCUMENTS

2003/0040443 A1* 2/2003 Poirier ..... C10M 169/04 508/406

FOREIGN PATENT DOCUMENTS

JP 2001-115180 A 4/2001

* cited by examiner

*Primary Examiner* — Cephia D Toomer
(74) *Attorney, Agent, or Firm* — Banner & Witcoff, Ltd.

(57) ABSTRACT

A conductive lubricating oil composition including at least one lubricating base oil selected from the group consisting of compounds represented by the following General Formula (1) and compounds represented by the following General Formula (2), and at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris (trifluoromethanesulfonyl)methide, in an amount of from 0.01% by mass to 1% by mass, and having a rate of change in conductivity after storage at 120° C. for 200 hours of 10% or less. The definitions of $R^1$, $R^2$, m and n in the formulae are as indicated in the specification. Cases of m−n=2 are excluded.

(1)

(Continued)

-continued
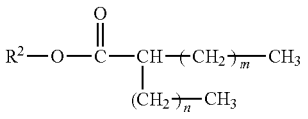
(2)
3 Claims, 1 Drawing Sheet
(51) Int. Cl.
| | |
|---|---|
| ***C10M 133/12*** | (2006.01) |
| ***C10M 129/10*** | (2006.01) |
| ***C10M 135/10*** | (2006.01) |
(52) U.S. Cl.
CPC ..... *C10M 133/12* (2013.01); *C10M 135/10* (2013.01); *C10M 2207/026* (2013.01); *C10M 2207/2815* (2013.01); *C10M 2215/064* (2013.01); *C10M 2215/065* (2013.01); *C10M 2219/044* (2013.01); *C10M 2223/049* (2013.01); *C10N 2210/01* (2013.01); *C10N 2220/028* (2013.01); *C10N 2230/02* (2013.01); *C10N 2230/08* (2013.01); *C10N 2230/10* (2013.01); *C10N 2240/02* (2013.01); *C10N 2240/20* (2013.01)
(58) Field of Classification Search
CPC .... C10M 2207/2815; C10M 2207/026; C10M 2215/064; C10M 2215/065; C10M 2223/049; C10N 2240/02; C10N 2210/01; C10N 2230/10; C10N 2230/02; C10N 2220/028; C10N 2230/08; C10N 2240/20
See application file for complete search history.

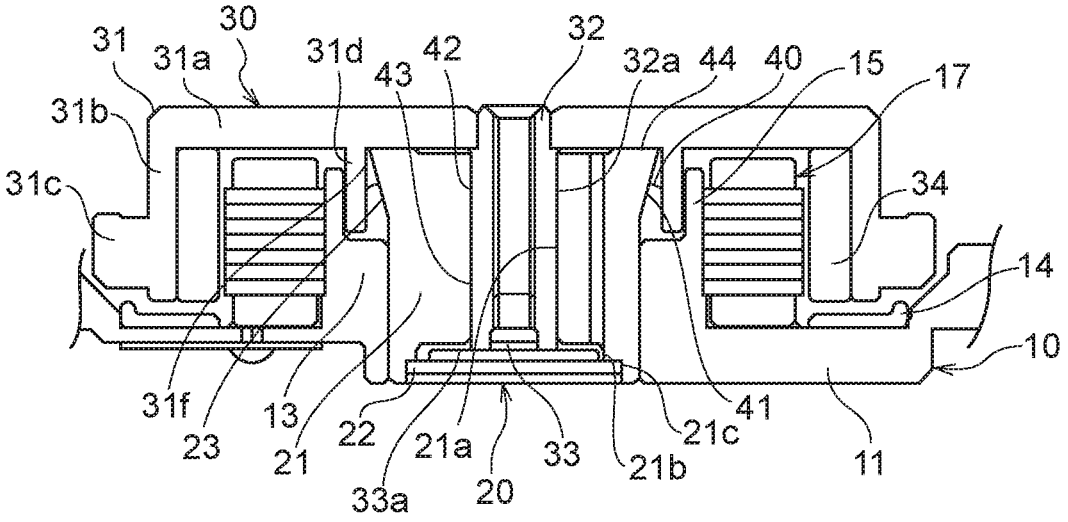
30
31
31a
31d
43
42
32
32a
44
40
15
17
31b
31c
34
14
10
31f
23
13
21
22
33a
21a
20
33
21b
21c
41
11

CONDUCTIVE LUBRICATING OIL COMPOSITION AND SPINDLE MOTOR

CROSS-REFERENCE TO RELATED APPLICATION

This application claims priority under 35 USC 119 from Japanese Patent Application No. 2017-202533 filed on Oct. 19, 2017, the disclosure of which is incorporated by reference herein.

BACKGROUND

Technical Filed

The present disclosure relates to a conductive lubricating oil composition and a spindle motor.

Related Art

In recent years, advancement and miniaturization of precision instruments such as personal computers or other peripheral equipment are progressing. A lubricating oil composition used for a high-speed rotating part of such precision instruments is sometimes required to have conductivity in order to suppress charging of static electricity generated by the friction of the high-speed rotating part. As a lubricating oil composition to which conductivity is imparted, for example, a conductive lubricant for dynamic pressure bearing containing an ester base oil and an anionic, cationic, amphoteric or non-ionic antistatic agent has been suggested (for example, refer to Japanese Patent Application Laid-Open (JP-A) No. 2001-115180).

SUMMARY

In cases in which nonionic (non-ionic) and ionic (anionic, cationic, amphoteric) antistatic agents are used in a lubricating oil composition, there are problems in that conductivity of the lubricating oil composition fluctuates, depending on the amount of water contained in the lubricating oil composition or the like, and the like. The antistatic agent has insufficient stability at high temperature depending on the type, and there are problems in that conductivity greatly fluctuates when the lubricating oil composition is used for a long period, and the like.

The present disclosure has been made in view of the circumstances as described above. One embodiment of the present disclosure provides a conductive lubricating oil composition excellent in temporal stability of conductivity. Another embodiment of the present disclosure provides a spindle motor using the conductive lubricating oil composition.

As a result of extensive research in view of the above circumstances, the present inventors have found that when a specific base oil and a specific conductivity imparting agent are combined, a change in conductivity is suppressed and a conductive lubricating oil composition that is stable for a long period can be obtained.

The present disclosure includes the following mode <1>, <2>, or <3>.

<1> A conductive lubricating oil composition including at least one lubricating base oil selected from the group consisting of a compound represented by the following General Formula (1) and a compound represented by the following General Formula (2), and at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris(trifluoromethanesulfonyl)methide, in an amount of from 0.01% by mass to 1% by mass with respect to a total mass of the composition, the conductive lubricating oil composition having an absolute value of a rate of change in conductivity after storage at 120° C. for 200 hours of 10% or less, (1)

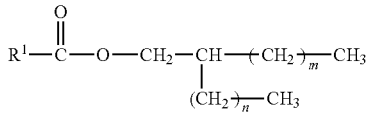

wherein, in General Formula (1). $R^1$ represents a linear or branched alkyl group having from 8 to 16 carbon atoms or a heteroalkyl group containing an oxygen atom, and each of m and n independently represents an integer from 5 to 11 (excluding cases of m−n=2), and (2)

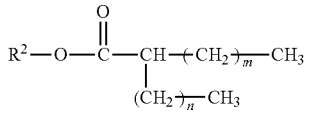

wherein, in General Formula (2), $R^2$ represents a linear or branched alkyl group having from 8 to 16 carbon atoms or a heteroalkyl group containing an oxygen atom, and each of m and n independently represents an integer from 5 to 11 (excluding cases of m−n=2).

<2> The conductive lubricating oil composition according to the above <1>, further including at least one antioxidant selected from the group consisting of a diphenylamine compound, an alkylated phenyl-α-naphthylamine, a hindered phenol compound, and a phosphite, in an amount of from 0.05% by mass to 2% by mass with respect to the total mass of the composition.

<3> A spindle motor including a stationary part including a stator, a rotating part including a rotor magnet, and a fluid dynamic pressure bearing part with the conductive lubricating oil composition of the above <1> or <2> arranged therein.

According to the above-described modes of the present disclosure, a conductive lubricating oil composition excellent in temporal stability of conductivity and a spindle motor using the same are provided.

BRIEF DESCRIPTION OF THE DRAWINGS

FIG. 1 is a schematic configuration diagram showing an example of a configuration of a spindle motor to which a conductive lubricating oil composition of the present disclosure is applied.

DETAILED DESCRIPTION

Hereinafter, a conductive lubricating oil composition of the present disclosure and preferable application modes thereof (for example, a spindle motor) will be described in detail. In the present disclosure, "to" representing a numerical range represents a range including the numerical values described as the upper limit and the lower limit thereof, respectively. In a case in which the unit of only the upper limit value is described in the numerical range represented by "to", this means that the lower limit value is also the same unit.

In the present disclosure, a combination of two or more preferred modes is a more preferred mode.

In a case in which the amount of a component in the composition is indicated in the present disclosure, when there are plural substances corresponding to the component in the composition, the indicated amount means the total amount of the plural substances present in the composition, unless specifically stated otherwise.

The conductive lubricating oil composition of the present disclosure includes at least one lubricating base oil selected from the compound represented by General Formula (1) and General Formula (2) (hereinafter collectively referred to as "specific lubricating base oil" if appropriate, and the detail thereof will be described later.), and at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris(trifluoromethanesulfonyl)methide, in an amount of from 0.01% by mass to 1% by mass, and has a rate of change in conductivity after storage at 120° C. for 200 hours of 10% or less.

The conductive lubricating oil composition may contain components other than those described above if necessary.

As a result of extensive research, the present inventors have found that by combining a specific lubricating base oil and at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris(trifluoromethanesulfonyl)methide, a conductive lubricating oil composition excellent in temporal stability of conductivity is obtained.

In a case in which such a conductive lubricating oil composition is used, for example, in a sliding portion or a rotating portion of a precision instrument, excellent lubricity can be achieved while stably ensuring conductivity.

Hereinafter, the conductive lubricating oil composition of the present disclosure will be specifically described.

<Conductivity Imparting Agent>

The conductive lubricating oil composition of the present disclosure contains at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris(trifluoromethanesulfonyl)methide, in an amount of from 0.01% by mass to 1% by mass.

The conductivity imparting agent contained in the conductive lubricating oil composition of the present disclosure may be at least one selected from the group consisting of potassium trifluoromethanesulfonate, lithium trifluoromethanesulfonate, lithium nonafluorobutanesulfonate, lithium bis(trifluoromethanesulfonyl)imide, and potassium bis(trifluoromethanesulfonyl)imide.

The content of the conductivity imparting agent is from 0.01% by mass to 1% by mass, preferably from 0.01% by mass to 0.5% by mass, and more preferably from 0.01% by mass to 0.1% by mass with respect to a total mass of the composition.

When the content of the conductivity imparting agent is 0.01% by mass or more, conductivity of the lubricating oil composition is improved, and when the content is 1% by mass or less, conductivity commensurate with the content can be imparted.

The conductivity imparting agent may be contained singly, or in combination of two or more kinds thereof. The content of the conductivity imparting agents in a case in which two or more kinds thereof are contained in combination is preferably within the above-mentioned ranges in the total amount.

<Lubricating Base Oil>

The conductive lubricating oil composition of the present disclosure contains at least one lubricating base oil (specific lubricating oil base oil) selected from the group consisting of a compound represented by the following General Formula (1) and a compound represented by the following General Formula (2).

The conductive lubricating oil composition of the present disclosure may contain only the compound represented by General Formula (1) as the specific lubricating base oil, may contain only the compound represented by General Formula (2), or may contain both the compound represented by General Formula (1) and the compound represented by General Formula (2). Each of the compound represented by General Formula (1) and the compound represented by General Formula (2) may be contained singly, or in combination of two or more kinds thereof

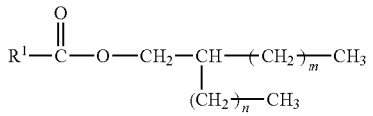

(1)

In General Formula (1), $R^1$ represents a linear or branched alkyl group having from 8 to 16 carbon atoms or a heteroalkyl group containing an oxygen atom. The heteroalkyl group containing an oxygen atom represented by $R^1$ may contain one oxygen atom or a plurality of oxygen atoms.

In General Formula (1), each of m and n independently represents an integer from 5 to 11. Cases of m−n=2 are excluded.

The linear or branched alkyl group having from 8 to 16 carbon atoms represented by $R^1$ is preferably a linear alkyl group having from 9 to 13 carbon atoms, more preferably an n-undecyl group, an n-nonyl group or an n-tridecyl group, and more preferably an n-undecyl group, from the viewpoint of temporal stability of conductivity.

The heteroalkyl group containing an oxygen atom represented by $R^1$ is preferably a linear heteroalkyl group having from 9 to 13 carbon atoms, more preferably $—(CH_2)_3—O—(CH_2)_6$, $—(CH_2)_3—O—(CH_2)_8$, or $—(CH_2)_3—O—(CH_2)_{10}$, and still more preferably $—(CH_2)_3—O—(CH_2)_8$, from the viewpoint of temporal stability of conductivity.

Each of m and n independently represents an integer from 5 to 11, and m and n are both preferably odd numbers from the viewpoint of easy availability of raw materials. However, the compound represented by General Formula (1) does not include compounds in which m−n=2.

Examples of the compound represented by General Formula (1) include the following compounds (1-1), (1-2), (1-3) and (1-4), but are not limited thereto.

$R^1$=undecyl group, $m$=9,$n$=5 Compound (1-1):

$R^1$=undecyl group, $m$=7,$n$=7 Compound (1-2):

$R^1$=—$(CH_2)_3$—O—$(CH_2)_8$,$m$=7,$n$=7 Compound (1-3):

$R^1$=—$(CH_2)_3$—O—$(CH_2)_8$,$m$=9,$n$=5 Compound (1-4):

A mixture of the compound (1-1) and the compound (1-2) and a mixture of the compound (1-3) and the compound (1-4) are each one of preferable modes of the specific lubricating base oil.

(2)

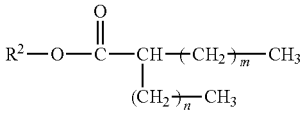

In General Formula (2), $R^2$ represents a linear or branched alkyl group having from 8 to 16 carbon atoms or a heteroalkyl group containing an oxygen atom. The heteroalkyl group containing an oxygen atom represented by $R^2$ may contain one oxygen atom or a plurality of oxygen atoms.

In General Formula (2), each of m and n independently represents an integer from 5 to 11. Cases of m−n=2 are excluded.

The linear or branched alkyl group having from 8 to 16 carbon atoms represented by $R^2$ is preferably a linear alkyl group having from 9 to 13 carbon atoms, more preferably an n-undecyl group, an n-nonyl group or an n-tridecyl group, and more preferably an n-undecyl group, from the viewpoint of temporal stability of conductivity.

The heteroalkyl group containing an oxygen atom represented by $R^2$ is preferably a heteroalkyl group having from 9 to 13 carbon atoms, preferably —$(CH_2)_5$—O—$(CH_2)_7$—$CH_3$, —$(CH_2)_2$—O—$CH_2$—CH($CH_2$—$CH_3$)—$(CH_2)_3$—$CH_3$, or —$(CH_2)_2$—O—$(CH_2)_2$—$CH_2$—CH($CH_2$—$CH_1$)—$(CH_2)_3$—$CH_3$, and more preferably —$(CH_2)_5$—O—$(CH_2)_7$—$CH_3$.

Each of m and n independently represents an integer from 5 to 11, and m and n are preferably odd numbers from the viewpoint of easy availability of raw materials. However, the compound represented by General Formula (2) does not include compounds in which m−n=2.

Examples of the compound represented by General Formula (2) include the following compounds (2-1), (2-2), (2-3) and (2-4), but are not limited thereto.

$R^2$=—$(CH_2)_5$—O—$(CH_2)_7$—$CH_3$,$m$=9,$n$=5 Compound (2-1):

$R^2$=—$(CH_2)_5$—O—$(CH_2)_7$—$CH_3$,$m$=7,$n$=7 Compound (2-2):

$R^2$=$n$-undecyl group, $m$=9,$n$=5 Compound (2-3):

$R^2$=$n$-undecyl group, $m$=7,$n$=7 Compound (2-4):

A mixture of the compound (2-1) and the compound (2-2) and a mixture of the compound (2-3) and the compound (2-4) are each one of preferable modes of the specific lubricating base oil.

The conductive lubricating oil composition of the present disclosure may contain a known lubricating base oil other than the specific lubricating base oil within a range not impairing the effect, and preferably contains only the specific lubricating base oil as the lubricating base oil.

<Antioxidant>

The conductive lubricating oil composition of the present disclosure preferably contains at least one antioxidant.

Examples of the antioxidant include antioxidants such as a diphenylamine compound, an alkylated phenyl-α-naphthylamine, a hindered phenol compound, or a phosphite. From the viewpoint of keeping the rate of change in conductivity of the conductive lubricating oil composition at high temperature low, the above-mentioned antioxidant is suitably used.

Examples of the diphenylamine compound include a compound represented by the following General Formula (3).

(3)

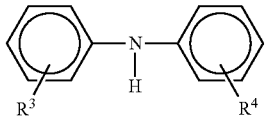

In General Formula (3), each of $R^3$ and $R^4$ independently represents a hydrogen atom or a linear or branched alkyl group having from 1 to 16 carbon atoms. $R^3$ and $R^4$ may be the same or different.

Specific examples of the linear or branched alkyl group represented by $R^3$ or $R^4$ include a methyl group, an ethyl group, an n-propyl group, an isopropyl group, an n-butyl group, an isobutyl group, a tert-butyl group, an n-pentyl group, an isopentyl group, a neopentyl group, a tert-pentyl group, a 2-methylbutyl group, an n-hexyl group, an isohexyl group, a 3-methylpentyl group, an ethylbutyl group, an n-heptyl group, a 2-methylhexyl group, an n-octyl group, a 2-ethylhexyl group, a 3-methylheptyl group, an n-nonyl group, a methyloctyl group, an ethylheptyl group, an n-decyl group, an n-undecyl group, an n-dodecyl group, and an n-tetradecyl group.

$R^3$ and $R^4$ are preferably a hydrogen atom or a linear or branched alkyl group having from 3 to 9 carbon atoms, and more preferably a hydrogen atom or a linear or branched alkyl group having from 4 to 8 carbon atoms.

The diphenylamine compound may be contained singly, or in combination of two or more kinds thereof.

Examples of the alkylated phenyl-α-naphthylamine include a compound represented by the following General Formula (4).

(4)

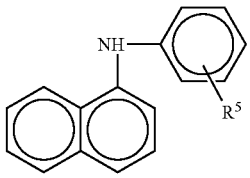

In General Formula (4), $R^5$ represents a linear or branched alkyl group having from 1 to 16 carbon atoms.

Specific examples of the linear or branched alkyl group represented by $R^5$ include a methyl group, an ethyl group, an n-propyl group, an isopropyl group, an n-butyl group, an isobutyl group, a tert-butyl group, an n-pentyl group, an isopentyl group, a neopentyl group, a tert-pentyl group, a 2-methylbutyl group, an n-hexyl group, an isohexyl group, a 3-methylpentyl group, an ethylbutyl group, an n-heptyl group, a 2-methylhexyl group, an n-octyl group, a 2-ethylhexyl group, a 3-methylheptyl group, an n-nonyl group, a methyloctyl group, an ethylheptyl group, an n-decyl group, an n-undecyl group, an n-dodecyl group, and an n-tetradecyl group.

$R^5$ is preferably a linear or branched alkyl group having from 4 to 8 carbon atoms.

The alkylated phenyl-α-naphthylamine may be contained singly, or in combination of two or more kinds thereof.

Examples of the hindered phenol compound include compounds represented by the following General Formula (5), General Formula (6), or General Formula (7).

(5)

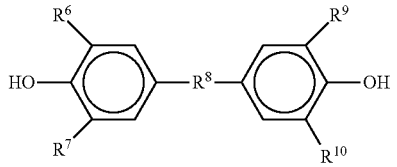

In General Formula (5), each of $R^6$, $R^7$, $R^9$, and $R^{10}$ independently represents a hydrogen atom or a linear or branched alkyl group having from 1 to 12 carbon atoms. $R^8$, $R^9$, $R^{11}$, and $R^{12}$ may be the same or different.

Specific examples of the linear or branched alkyl group represented by $R^6$, $R^7$, $R^9$, and $R^{10}$ include a methyl group, an ethyl group, an n-propyl group, an isopropyl group, an n-butyl group, an isobutyl group, a tert-butyl group, an n-pentyl group, an isopentyl group, a neopentyl group, a tert-pentyl group, a 2-methylbutyl group, an n-hexyl group, an isohexyl group, a 3-methylpentyl group, an ethylbutyl group, an n-heptyl group, a 2-methylhexyl group, an n-octyl group, a 2-ethylhexyl group, a 3-methylheptyl group, an n-nonyl group, a methyloctyl group, an ethylheptyl group, an n-decyl group, an n-undecyl group, and an n-dodecyl group.

$R^6$, $R^7$, $R^9$, and $R^{10}$ are preferably a hydrogen atom or a linear or branched alkyl group having from 4 to 8 carbon atoms.

In General Formula (5), $R^8$ represents an alkylene group having from 1 to 5 carbon atoms.

Specific examples of the alkylene group represented by $R^8$ include a methylene group, an ethylene group, a propylene group, a butylene group, and a pentylene group.

$R^8$ is preferably an alkylene group having from 1 to 4 carbon atoms.

(6)

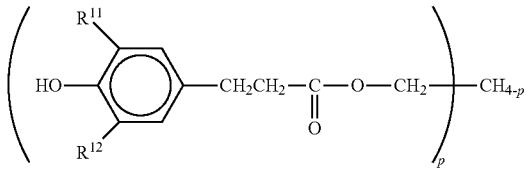

In General Formula (6), each of $R^{11}$ and $R^{12}$ independently represents a hydrogen atom or a linear or branched alkyl group having from 1 to 12 carbon atoms. $R^{11}$ and $R^{12}$ may be the same or different.

Specific examples of the linear or branched alkyl group represented by $R^{11}$ and $R^{12}$ include the same groups as $R^6$, $R^7$, $R^9$, and $R^{10}$ in General Formula (5).

$R^{11}$ and $R^{12}$ are preferably a hydrogen atom or a linear or branched alkyl group having from 4 to 8 carbon atoms.

In General Formula (6), p represents an integer from 1 to 4, and preferably an integer from 1 to 3.

(7)

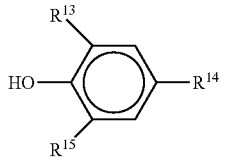

In General Formula (7), each of $R^{13}$, $R^{14}$, and $R^{15}$ independently represents a hydrogen atom or a linear or branched alkyl group having from 1 to 12 carbon atoms. $R^{13}$, $R^{14}$, and $R^{15}$ may be the same or different.

Specific examples of the linear or branched alkyl group represented by $R^{13}$, $R^{14}$, and $R^{15}$ include the same groups as $R^6$, $R^7$, $R^9$, and $R^{10}$ in General Formula (5).

$R^{13}$ and $R^{14}$ are preferably a hydrogen atom or a linear or branched alkyl group having from 4 to 8 carbon atoms, and $R^{15}$ is preferably a hydrogen atom or a linear or branched alkyl group having from 1 to 4 carbon atoms.

The hindered phenol compound may be contained singly, or in combination of two or more kinds thereof.

Examples of the phosphite include a compound represented by the following General Formula (8).

(8)

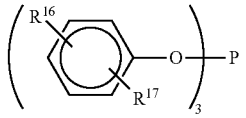

In General Formula (8), each of $R^{16}$ and $R^{17}$ independently represents a linear or branched alkyl group having from 1 to 20 carbon atoms. $R^{16}$ and $R^{17}$ may be the same or different.

Specific examples of the linear or branched alkyl group represented by $R^{16}$ and $R^{17}$ include a methyl group, an ethyl group, an n-propyl group, an isopropyl group, an n-butyl group, an isobutyl group, a tert-butyl group, an n-pentyl group, an isopentyl group, a neopentyl group, a tert-pentyl group, a 2-methylbutyl group, an n-hexyl group, an isohexyl group, a 3-methylpentyl group, an ethylbutyl group, an n-heptyl group, a 2-methylhexyl group, an n-octyl group, a 2-ethylhexyl group, a 3-methylheptyl group, an n-nonyl group, a methyloctyl group, an ethylheptyl group, an n-decyl group, an n-undecyl group, an n-dodecyl group, and an n-tetradecyl group.

$R^{16}$ and $R^{17}$ are preferably a linear or branched alkyl group having from 2 to 6 carbon atoms.

The phosphite may be contained singly, or in combination of two or more kinds thereof.

The content of the antioxidant is preferably from 0.05% by mass to 2.0% by mass, more preferably from 0.25% by mass to 1.5% by mass, and still more preferably from 0.5% by mass to 1.0% by mass with respect to the total mass of the composition. When the content of the antioxidant is 0.05% by mass or more, fluctuation in conductivity of the conductive lubricating oil composition at high temperature is further suppressed.

The antioxidant may be contained singly, or in combination of two or more kinds thereof. The content of the antioxidants in a case in which two or more kinds thereof are contained in combination is preferably within the above-mentioned ranges in the total amount.

In the conductive lubricating oil composition, the ratio of the antioxidant to the above-described conductivity imparting agent (antioxidant/conductivity imparting agent) is preferably from 0.05 to 200 and more preferably from 0.5 to 150 on a mass basis. When the ratio is 0.05 or more, the change of conductivity with time is suppressed, and when the ratio is 200 or less, an effect commensurate with the addition amount can be obtained.

<Other Additives>

The conductive lubricating oil composition of the present invention may further contain typical lubricating oil additives such as metal deactivators, rust inhibitors, anti-wear agents, pour point depressants, viscosity index improvers, or hydrolysis inhibitors.

<Conductivity of Conductive Lubricating Oil Composition>

The conductive lubricating oil composition of the present disclosure has a conductivity at 80° C. of preferably 10,000 pS/m or more, and more preferably from 10,000 pS/m to 100,000 pS/m. When the conductivity is 10,000 pS/m or more, charging of the generated static electricity can be suppressed.

The conductivity can be measured using a conductivity meter (for example, a HANDY CONDUCTIVITY METER 1152 manufactured by Emcee Electronics, Inc.) by heating the conductive lubricating oil composition to 80° C., and inserting a probe of the conductivity meter while stirring.

The conductive lubricating oil composition of the present disclosure has an absolute value of the rate of change in conductivity after storage at 120° C. for 200 hours of 10% or less. The rate of change in conductivity is more preferably 9% or less, still more preferably 6% or less, still more preferably 5% or less, still more preferably 3% or less, and particularly preferably 1.5% or less.

The lower the rate of change in conductivity, the more stable the conductivity can be maintained over a long period of time.

The rate of change in conductivity can be determined by measuring the conductivity of the conductive lubricating oil composition before and after 200 hours of storage under the condition of 120° C. and substituting the conductivity into the following Equation A.

$$\text{Rate of Change in Conductivity (\%)} = (|[(\text{Conductivity after Storage (pS/m)}) - (\text{Conductivity Before Storage (pS/m)})]| / (\text{Conductivity Before Storage (pS/m)})) \times 100 \quad \text{Equation A}$$

<Kinematic Viscosity and Viscosity Index of Conductive Lubricating Oil Composition>

The conductive lubricating oil composition of the present disclosure has a kinematic viscosity at 40° C. of preferably from 6 $mm^2/s$ to 15 $mm^2/s$, and more preferably from 9.0 $mm^2/s$ to 14.5 $mm^2/s$. When the kinematic viscosity at 40° C. is 6 $mm^2/s$ or more, evaporation loss is suppressed and sufficient lubrication performance can be maintained. When the kinematic viscosity at 40° C. is 15 $mm^2/s$ or less, a decrease in the viscous torque when used in a precision instrument or the like and lowering of low temperature fluidity are suppressed Therefore, it is considered that the range of the kinematic viscosity of from 6 $mm^2/s$ to 15 $mm^2/s$ is favorable from the viewpoint of low power consumption, evaporation loss, and lubrication performance.

The conductive lubricating oil composition of the present disclosure has a viscosity index of preferably 110 or more, more preferably 120 or more, and still more preferably 130 or more. When the viscosity index is 110 or more, viscosity change with temperature change is suppressed, and an increase in the viscous torque at low temperature is suppressed.

The kinematic viscosity at 40° C. of the composition is a value measured by the method specified in JIS-K-2283: 2000 (ASTM D445). The viscosity index of the composition is a value measured by the method specified in JIS K 2283: 2000 (ASTM D2270).

<Usage of Conductive Lubricating Oil Composition>

The conductive lubricating oil composition of the present disclosure can be used as a lubricating oil for motors or bearings of various precision instruments such as, for example, CD-Rs, DVD-Rs, HDDs, and watches.

In particular, by using the conductive lubricating oil composition of the present disclosure in a sliding portion or rotating portion of the precision instruments described above, excellent lubrication performance is exhibited while stably ensuring conductivity.

Specifically, the conductive lubricating oil composition of the present disclosure can be suitably used for a fluid dynamic pressure bearing or a sintered impregnated bearing used in a bearing part of a rotating body such as a spindle motor. For example, in the spindle motor including a stationary part including a stator, a rotating part including a rotor magnet, and a fluid dynamic pressure bearing part, the conductive lubricating oil composition of the present disclosure can be suitably applied to the fluid dynamic pressure bearing part.

FIG. 1 is a schematic configuration diagram showing an example of a configuration of a spindle motor to which a conductive lubricating oil composition of the present disclosure is applied. The spindle motor shown in FIG. 1 includes a stationary part 20 and a rotating part 30. By the fluid dynamic pressure bearing as the preferred embodiment, the rotating part 30 is rotatably supported with respect to the stationary part 20. In the following description, when describing the positional relationship and direction of each member vertically and laterally, the positional relationships and directions in the drawings are merely shown, and the positional relationship or direction when each member is incorporated in an actual instrument is not shown.

A base 10 has a flat portion 11 and an annular boss portion 13 provided at the center of the flat portion 11. There is an annular concave portion between the annular boss portion 13 and an annular step portion 14 provided on the outer peripheral portion of the flat portion 11. A stator 17 and a rotor magnet 34 attached to a hub 31 to be described later are arranged in the annular concave portion. The annular boss portion 13 has a cylindrical support wall 15 protruding upward, and the stator 17 is fixed to the cylindrical support wall 15.

A bearing stationary part 20 constituting a part of the fluid dynamic pressure bearing part is arranged inside the annular boss portion 13. The bearing stationary part 20 includes a sleeve 21 having a substantially cylindrical shape and a counter plate 22 closing the lower opening of the sleeve 21. The inner peripheral surface of the sleeve 21 includes a small-diameter inner peripheral surface 21*a*, a medium-diameter inner peripheral surface 21*b*, and a large-diameter inner peripheral surface 21*c*. The small-diameter inner peripheral surface 21*a* is a radial bearing surface. The medium-diameter inner peripheral surface 21*b* is located at a lower part of the sleeve 21 and has an outer diameter larger than that of the small-diameter inner peripheral surface 21*a*. The large-diameter inner peripheral surface 21*c* is located at the lower end of the sleeve 21 and has an outer diameter larger than that of the medium-diameter inner peripheral surface 21*b*. The counter plate 22 is arranged on the large-diameter inner peripheral surface 21*c* and fixed to the sleeve 21. A tapered surface 23 described later is arranged on the upper outer peripheral surface of the sleeve 21.

The rotating part 30 includes a rotor hub 31 and a shaft 32 fixed to the rotor hub 31. The rotor hub 31 is formed of a ferromagnetic material such as iron or stainless steel. A cylindrical portion 31*b* is arranged on the outer peripheral portion of a disk portion 31*a*. A flange portion 31*c* extending radially outward from the cylindrical portion 31*b* is arranged in a lower part of the cylindrical portion 31*b*. An annular wall 31*d* extending downward from the disk portion 31*a* is arranged inside the cylindrical portion 31*b*. An outer peripheral surface 32*a* of the shaft 32 and the small-diameter inner peripheral surface 21*a* of the sleeve 21 face in a radial direction with a minute gap.

A stopper 33 is arranged in a lower part of the shaft 32. The outer diameter of a plate portion 33*a* of the stopper 33 is larger than the outer diameter of the shaft 32 and smaller than the inner diameter of the medium-diameter inner peripheral surface 21*b*. The plate portion 33*a* contacts the sleeve 21, whereby the shaft 32 is prevented from coming off from the sleeve 21.

The annular rotor magnet 34 is arranged inside the cylindrical portion 31*b* of the rotor hub 31. The rotor magnet 34 faces the stator 17 with a gap. On the flange portion 31*c* of the rotor hub 31, one or a plurality of recording disks are arranged.

There are minute gaps between the small-diameter inner peripheral surface 21*a* of the sleeve 21 and the outer peripheral surface 32*a* of the shaft 32 and between the lower surface of the disk portion 31*a* of the rotor hub 31 and the upper end surface of the sleeve 21, respectively, and the minute gaps are filled with a conductive lubricating oil 40 (i.e., the conductive lubricating oil composition of the present disclosure) as a bearing oil. The conductive lubricating oil 40 also fills a space surrounded by the medium-diameter inner peripheral surface 21*b* of the sleeve 21, the upper surface of the counter plate 22, and the circular plate portion 33*a* of the stopper 33. A tapered seal portion 41 is constituted between an inner peripheral surface 31*f* of the annular wall 31*d* of the rotor hub 31 and the tapered surface 23 of the upper outer periphery of the sleeve 21. The gap of the tapered seal portion 41 is narrowed as going upward. The conductive lubricating oil 40 is present in the tapered seal portion 41, and a gas-liquid interface of the conductive lubricating oil 40 is located in the tapered seal portion 41.

On the small-diameter inner peripheral surface 21*a* of the sleeve 21, for example, a herringbone-shaped dynamic pressure generating groove array is arranged. A pair of radial dynamic pressure bearings 42, 43 are constituted in a minute gap between the small-diameter inner peripheral surface 21*a* of the sleeve 21 and the outer peripheral surface 32*a* of the shaft 32. When the spindle motor rotates, the shaft 32 is supported in a radial direction by dynamic pressure generated by the herringbone-shaped dynamic pressure generating groove array. On the upper end surface of the sleeve 21, for example, a spiral dynamic pressure generating groove array is arranged. A thrust dynamic pressure bearing 44 is constituted in the minute gap between the upper end surface of the sleeve 21 and the lower surface of the disk portion 31*a*. When the spindle motor rotates, the rotor hub 31 floats due to the dynamic pressure generated by the spiral dynamic pressure generating groove array.

Examples

Hereinafter, the content of the lubricating oil composition of the present disclosure will be specifically described based on examples, but the lubricating oil composition of the present disclosure and its application modes are not limited by these examples at all.

In the examples and comparative examples, "a HANDY CONDUCTIVITY METER 1152 manufactured by Emcee Electronics, Inc." was used for measurement of conductivity. The sample placed in a light shielding bottle was heated to 80° C. with a hot stirrer, a probe of the conductivity meter was inserted while stirring, and measurement was performed.

With respect to the rate of change in conductivity, a conductive lubricating oil composition after storage under a condition of 120° C., which is more severe than a normal use condition, was evaluated at 80° C.

The kinematic viscosity and viscosity index of the composition were measured by the method described above.

The rate of change in conductivity is the absolute value of the rate of change calculated according to Equation A described above.

Examples 1 to 6

Each component was blended at a ratio (% by mass) shown in the following Table 1 to prepare a conductive lubricating oil composition of each example.

Each of the prepared compositions was stored in a thermostat at 120° C. for 200 hours, and the conductivity before and after storage was measured to calculate the rate of change. Each of the compositions was stored by allowing each composition placed in a light shielding bottle to stand still in a thermostat (DRN420DB manufactured by Advantech Co, Ltd.), with setting only the temperature to 120° C. without adding pressure and humidity. The results are shown in the following Table 1.

TABLE 1

| | | Example 1 | Example 2 | Example 3 | Example 4 | Example 5 | Example 6 |
|---|---|---|---|---|---|---|---|
| Base oil A | [% by mass] | 98.00 | 98.00 | — | — | — | — |
| Base oil B | [% by mass] | — | — | 98.00 | 98.00 | — | — |
| Base oil C | [% by mass] | — | — | — | — | 98.00 | — |
| Base oil D | [% by mass] | — | — | — | — | — | 98.00 |
| Antioxidant A | [% by mass] | 0.350 | 0.350 | 0.350 | 0.350 | 0.350 | 0.350 |
| Antioxidant B | [% by mass] | 0.200 | 0.200 | 0.200 | 0.200 | 0.200 | 0.200 |
| Antioxidant C | [% by mass] | 0.200 | 0.200 | 0.200 | 0.200 | 0.200 | 0.200 |
| Conductivity imparting agent A | [% by mass] | 0.050 | — | 0.050 | — | — | — |

TABLE 1-continued

| | | Example 1 | Example 2 | Example 3 | Example 4 | Example 5 | Example 6 |
|---|---|---|---|---|---|---|---|
| Conductivity imparting agent B | [% by mass] | — | 0.050 | — | — | — | — |
| Conductivity imparting agent C | [% by mass] | — | — | — | 0.050 | — | — |
| Conductivity imparting agent D | [% by mass] | — | — | — | — | 0.050 | — |
| Conductivity imparting agent E | [% by mass] | — | — | — | — | — | 0.050 |
| Other lubricating oil additives | [% by mass] | 1.200 | 1.200 | 1.200 | 1.200 | 1.200 | 1.200 |
| Kinematic viscosity (40° C.) | [$mm^2/s$] | 14.2 | 14.3 | 13.8 | 13.7 | 14.0 | 13.1 |
| Viscosity index | | 147 | 147 | 141 | 141 | 138 | 149 |
| Conductivity (0 h) | [pS/m] | 82100 | 31200 | 40200 | 39900 | 66200 | 55900 |
| Conductivity (200 h) | [pS/m] | 81900 | 29900 | 39700 | 37800 | 71200 | 51000 |
| Rate of change | [%] | 0.24 | 4.17 | 1.24 | 5.26 | 7.55 | 8.77 |

Details of each component in Table 1 are as follows.

(Base oil A) A mixture of a compound in which $R^2$ is —$(CH_2)_5$—O—$(CH_2)_7$—$CH_3$, and m=9 and n=5, and a compound in which $R^2$ is —$(CH_2)_5$—O—$(CH_2)_7$—$CH_3$, and m=7 and n=7, in General Formula (2).

(Base oil B) A mixture of a compound in which $R^1$ is —$(CH_2)_{10}$—$CH_3$, and m=9 and n=5, and a compound in which $R^1$ is —$(CH_2)_{10}$—$CH_3$, and m=7 and n=7, in General Formula (1).

(Base oil C) A mixture of a compound in which $R^1$ is —$(CH_2)_3$—O—$(CH_2)_8$, and m=7 and n=7, and a compound in which $R^1$ is —$(CH_2)_3$—O—$(CH_2)_8$, and m=9 and n=5, in General Formula (1).

(Base oil D) A mixture of a compound in which $R^2$ is an n-undecyl group, and m=7 and n=7, and a compound in which $R^2$ is an n-undecyl group, and m=9 and n=5, in General Formula (2).

(Antioxidant A) Alkylated phenyl-α-naphthylamine: a compound in which $R^5$ is a branched alkyl group having 7 carbon atoms in General Formula (4)

(Antioxidant B) Phosphite: a compound in which $R^{16}$ and $R^{17}$ are branched alkyl groups having 4 carbon atoms in General Formula (8)

(Antioxidant C) Alkylated diphenylamine: a compound in which $R^3$ and $R^4$ are branched alkyl groups having 7 carbon atoms in General Formula (4)

(Conductivity imparting agent A) Lithium bis(trifluoromethanesulfonyl)imide (Conductivity imparting agent B) Lithium trifluoromethanesulfonate (Conductivity imparting agent C) Potassium bis(trifluoromethanesulfonyl)imide (Conductivity imparting agent D) Potassium trifluoromethanesulfonate (Conductivity imparting agent E) Lithium nonafluorobutanesulfonate (Other lubricating oil additives) Metal deactivators, rust inhibitors, anti-wear agents, and hydrolysis inhibitors

Comparative Examples 1 and 2

Each component was blended at a ratio (% by mass) shown in the following Table 2 to prepare a conductive lubricating oil composition of each comparative example.

Each of the prepared compositions was stored in a thermostat at 120° C. for 200 hours, and the conductivity before and after storage was measured in the same manner as in Examples 1 to 6 to calculate the rate of change. The results are shown in the following Table 2.

TABLE 2

| | | Comparative Example 1 | Comparative Example 2 |
|---|---|---|---|
| Base oil A | [% by mass] | 98.00 | — |
| Base oil B | [% by mass] | — | 98.00 |
| Antioxidant A | [% by mass] | 0.350 | 0.350 |
| Antioxidant B | [% by mass] | 0.200 | 0.200 |
| Antioxidant C | [% by mass] | 0.200 | 0.200 |
| Conductivity imparting agent D | [% by mass] | 0.050 | — |
| Conductivity imparting agent E | [% by mass] | — | 0.050 |
| Other lubricating oil additives | [% by mass] | 1.200 | 1.200 |
| Kinematic viscosity (40° C.) | [$mm^2/s$] | 14.2 | 13.8 |
| Viscosity index | | 147 | 141 |
| Conductivity (0 h) | [pS/m] | 78700 | 76900 |
| Conductivity (200 h) | [pS/m] | 55100 | 49900 |
| Rate of change | [%] | 30 | 35.1 |

Details of each component in Table 2 are as follows.

Base oil A. Base oil B, Antioxidant A, Antioxidant B, Antioxidant C and other lubricating oil additives that are the same as those in Table 1 were used.

(Conductivity imparting agent D) Alkylnaphthalenesulfonate (Conductivity imparting agent E) Phosphate type anionic surfactant From Table 1 and Table 2, it is understood that the conductive lubricating oil compositions of Examples have a low rate of change in conductivity and are excellent in temporal stability of conductivity.

The conductive lubricating oil composition of the present disclosure can be used as a lubricating oil for motors or bearings of various precision instruments, for example, CD-R, DVD-R, HDD, and watch. Preferred application modes of the conductive lubricating oil composition of the present disclosure include a spindle motor.

All publications, patent applications, and technical standards mentioned in this specification are herein incorporated by reference to the same extent as if each individual publication, patent application, or technical standard was specifically and individually indicated to be incorporated by reference.

What is claimed is:

1. A conductive lubricating oil composition comprising:

at least one lubricating base oil selected from the group consisting of a compound represented by the following General Formula (1) and a compound represented by the following General Formula (2); and at least one conductivity imparting agent selected from the group consisting of potassium trifluoromethanesulfonate, lithium trifluoromethanesulfonate, lithium nonafluorobutanesulfonate, lithium bis(trifluoromethanesulfonyl)imide, potassium bis(trifluoromethanesulfonyl)imide, and lithium tris (trifluoromethanesulfonyl)methide, in an amount of from 0.01% by mass to 1% by mass with respect to a total mass of the composition, the conductive lubricating oil composition having an absolute value of a rate of change in conductivity after storage at 120° C. for 200 hours of 10% or less,

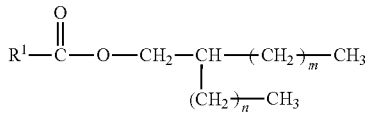

(1)

wherein, in General Formula (1), $R^1$ represents a linear or branched alkyl group having from 8 to 16 carbon atoms or a heteroalkyl group containing an oxygen atom, and each of m and n independently represents an integer from 5 to 11 (excluding cases of m−n=2), and

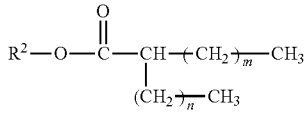

(2)

wherein, in General Formula (2), $R^2$ represents a linear or branched alkyl group having from 8 to 16 carbon atoms or a heteroalkyl group containing an oxygen atom, and each of m and n independently represents an integer from 5 to 11 (excluding cases of m−n=2).

2. The conductive lubricating oil composition according to claim 1, further comprising at least one antioxidant selected from the group consisting of a diphenylamine compound, an alkylated phenyl-α-naphthylamine, a hindered phenol compound, and a phosphite, in an amount of from 0.05% by mass to 2% by mass with respect to the total mass of the composition.

3. A spindle motor comprising a stationary part including a stator, a rotating part including a rotor magnet, and a fluid dynamic pressure bearing part with the conductive lubricating oil composition of claim 1 arranged therein.

* * * * *